United States Patent [19]

Peterson

[11] Patent Number: 4,975,991

[45] Date of Patent: Dec. 11, 1990

[54] BATHTUB SEAT APPARATUS

[76] Inventor: Alan D. Peterson, 614 Hermitage Park Dr., Hermitage, Tenn. 37076

[21] Appl. No.: 459,206

[22] Filed: Dec. 29, 1989

[51] Int. Cl.[5] ..... A47K 3/022; A47K 3/12

[52] U.S. Cl. ..... 4/579; 4/559; 4/571; 4/578; 4/605; 4/611

[58] Field of Search ..... 4/578, 579, 611, 571, 4/590, 661, 559, 605, 621; 297/153, 108, 165

[56] References Cited

U.S. PATENT DOCUMENTS

| | | | |
|---|---|---|---|
| 2,113,190 | 4/1938 | Bentz | 4/579 |
| 2,131,214 | 9/1938 | Bentz | 4/579 X |
| 2,151,581 | 3/1939 | Bentz | 4/579 |
| 2,852,785 | 9/1958 | Mikola | 4/579 |
| 3,385,631 | 5/1968 | Gertler | 297/111 |
| 4,521,926 | 6/1985 | Kuether | 4/579 |
| 4,574,409 | 3/1986 | McAffrey | 4/579 |
| 4,656,678 | 4/1987 | Lipski | 4/578 |

FOREIGN PATENT DOCUMENTS

| | | | |
|---|---|---|---|
| 3103424 | 9/1982 | Fed. Rep. of Germany | 4/578 |

*Primary Examiner*—Henry K. Artis
*Attorney, Agent, or Firm*—Leon Gilden

[57] ABSTRACT

An apparatus is set forth wherein an elliptical seat defined by a major and minor axis includes a plurality of diametrically opposed support legs aligned and coextensive with the minor axis of the elliptical seat, with the seat including a matrix of drainage apertures therethrough, as well as a comfort ridge aligned with the major axis of the elliptical seat. Modifications include telescoping members received within the seat support legs, as well as telescoping links for securing a foot rest member thereon. The foot rest member is also structured for sliding adjustment along the links for adjustment thereof relative to the links. Further, foot support members may include cushioned cavities defined within support members mounted to the seat by flexible lines.

3 Claims, 4 Drawing Sheets

BATHTUB SEAT APPARATUS

BACKGROUND OF THE INVENTION

1. Field of the Invention

The field of invention relates to bathtub apparatus, and more particularly pertains to a new and improved bathtub seat apparatus wherein the same is configured for securement within or upon sides of an associated bathtub.

2. Description of the Prior Art

Bathtub seats and the like are utilized in the prior art for comfort and securement of individuals during a bathing procedure to assist in the comfort enhancement of an individual during a bathing procedure. Examples of the prior art include U.S. Pat. No. 4,574,409 to McAffrey including a bath seat with a "U" shaped member defined by perimeter lips for positioning an individual thereon within a bathtub.

U.S. Pat. No. 2,113,190 to Bentz sets forth a bathtub seat including "L" shaped legs with a ratchet-like adjustment of a central seat positioned between the legs for securement interiorly of a bathtub.

U.S. Pat. No. 4,521,926 to Kuether sets forth a bath chair securable within a tub with a transfer seat provided for assisting invalids in entering the chair, with improved waterflow directed down a rearward portion of the seat for enhanced bathing thereof.

U.S. Pat. No. 2,151,581 to Bentz sets forth a bath seat formed with triangular side bracketry for securement to sloping interior walls of a bathtub, with a central seat mounted between the bracketry for positioning of an individual thereon.

U.S. Pat. No. 4,656,678 to Lipski sets forth a bath seat arrangement formed with a central seat including detachable or foldable connecting legs, wherein the seat has extensions thereon where soap or other toiletries may be deposited during use.

As such, it may be appreciated that there is a continuing need for a new and improved bathtub seat apparatus which addresses both the problems of ease of use as well as effectiveness in accommodating individuals in a variety of positions interiorly of a bathtub for enhanced bathing within the bathtub.

SUMMARY OF THE INVENTION

In view of the foregoing disadvantages inherent in the known types of bathtub apparatus now present in the prior art, the present invention provides a bathtub seat apparatus wherein the same includes a seat member for securement onto top side edges of the bathtub or within the side walls of the bathtub for positioning of an individual thereon. As such, the general purpose of the present invention, which will be described subsequently in greater detail, is to provide a new and improved bathtub seat apparatus which has all the advantages of the prior art bathtub apparatus and none of the disadvantages.

To attain this, the present invention includes an apparatus wherein an elliptical seat defined by a major and minor axis includes a plurality of diametrically opposed support legs aligned and coextensive with the minor axis of the elliptical seat, with the seat including a matrix of drainage apertures therethrough, as well as a comfort ridge aligned with the major axis of the elliptical seat. Modifications include telescoping members received within the seat support legs, as well as telescoping links for securing a foot rest member thereon.

The foot rest member is also structured for sliding adjustment along the links for adjustment thereof relative to the links. Further, foot support members may include cushioned cavities defined within support members mounted to the seat by flexible lines.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bathtub seat apparatus which has all the advantages of the prior art bathtub apparatus and none of the disadvantages.

It is another object of the present invention to provide a new and improved bathtub seat apparatus which may be easily and efficiently manufactured and marketed.

It is a further object of the present invention to provide a new and improved bathtub seat apparatus which is of a durable and reliable construction.

An even further object of the present invention is to provide a new and improved bathtub seat apparatus which is susceptible of a low cost of manufacture with regard to both materials and labor, and which accordingly is then susceptible of low prices of sale to the consuming public, thereby making such bathtub seat apparatus economically available to the buying public.

Still yet another object of the present invention is to provide a new and improved bathtub seat apparatus which provides in the apparatuses and methods of the prior art some of the advantages thereof, while simultaneously overcoming some of the disadvantages normally associated therewith.

Still another object of the present invention is to provide a new and improved bathtub seat apparatus wherein the same accommodates positioning on top side edges of or interiorly of a bathtub and provides for enhanced comfort during use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
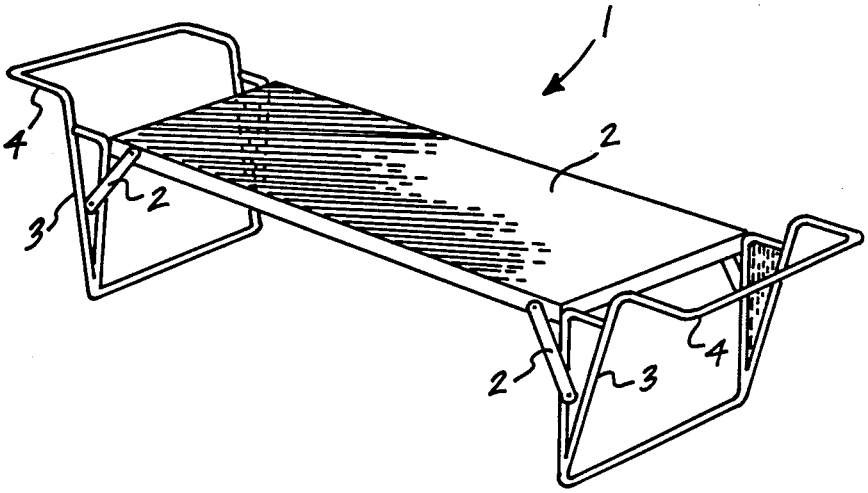
FIG. 1 is an isometric illustration of a prior art bathtub seat apparatus.

With reference now to the drawings, and in particular to FIGS. 1 to 9 thereof, a new and improved bathtub seat apparatus embodying the principles and concepts of the present invention and generally designated by the reference numerals 10, 10*a*, 10*b*, 10*c*, and 10*d* will be described.

FIG. 1 is illustrative of a typical prior art bathtub seat 1 comprising an essentially planar support 2 longitudinally suspended between opposed sides of a conventional bathtub, with triangular bracketry 3 arranged with orthogonally oriented loops 4 to overlie opposed bathtub top surfaces of the side walls to suspend the seat 2 within the bathtub.

Figure 4:
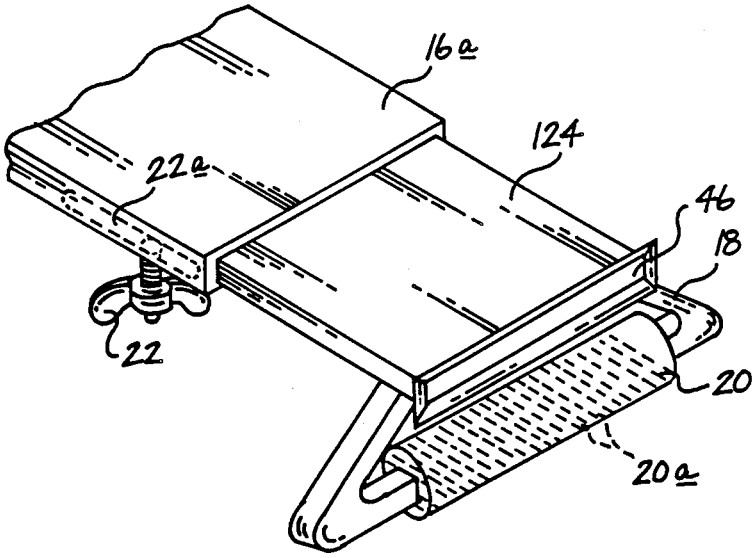
FIG. 4 is an isometric illustration of a modified extension wing telescopingly received within a support of the bathtub seat of the instant invention.

More specifically, the bathtub seat apparatus 10 essentially comprises an elliptical planar support surface 11 defined by a major axis 12 and a minor axis 13 orthogonally oriented thereto, including an elongate support ridge 14 aligned with the major axis 12. A respective first and second longitudinal support plate 15 and 16 are mounted opposed to one another from each side of the seat 11 aligned with the minor axis 13, and each include a respective first and second trapezoidal support 17 and 18 mounted to forward bottom surfaces of each of the support plates, with a respective first and second elongate support cushion 19 and 20 in surrounding relationship to a base member of each trapezoidal support. The elongate support cushions 19 and 20 are formed with a planar bottom contact surface, including a series of ribs 20*a* mounted along the planar contact surface, as illustrated in FIG. 4 for example.

Figure 3:
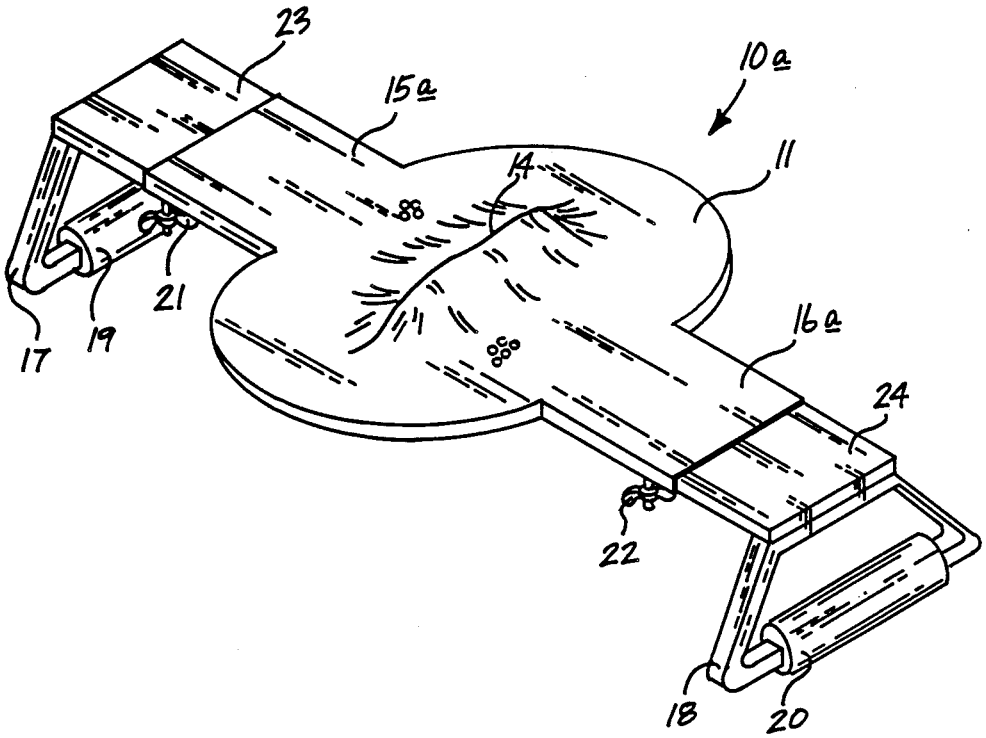
FIG. 3 is an isometric illustration of a modified bath seat apparatus of the instant invention.

FIG. 3 is illustrative of a modified bathtub seat apparatus 10*a* including an elliptical seat 11 with tubular longitudinal supports 15*a* and 16*a* extending and aligned with the minor axis of the elliptical support seat 11 that telescopingly receive respective first and second extension wings 23 and 24 of complementary configuration to the internal configuration of the tubular supports 15*a* and 16*a*, with a respective first and second frictional clamp 21 and 22 mounted to each external surface of the tubular support plates 15*a* and 16*a* to fixedly secure the associated first and second extension wings 23 and 24 therewithin. The friction clamps each include a stud member slidable within an associated slot, as exemplified in FIG. 4, wherein an associated slot 22*a* is mounted within the tubular support 16*a*, whereupon positioning of the associated modified extension wing 124, the associated wing nut is rotated to clamp the extension wing 124 relative to the tubular support 16*a*. Similarly, a like extension wing is mounted within a modified tubular support 15*a*. Further it should be noted that an elongate suction cup 46 is coextensive with a forward edge of the modified extension wing 124 that is clamped adjacent an interior wall of an associated bathtub to enhance securement and positioning of the apparatus within the bathtub. It should be understood that a like suction cup is mounted on a like extension wing mounted within the other tubular support 15*a* (not shown).

Figure 5:
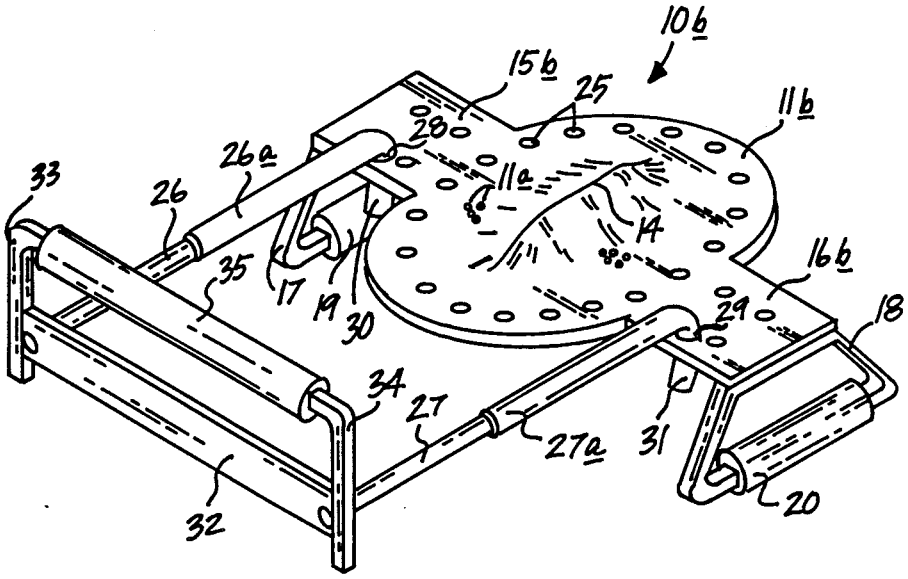
FIG. 5 is an isometric illustration of a bathtub seat apparatus of the instant invention.

FIG. 5 is illustrative of a further modified seat apparatus 10*b* that includes a modified elliptical planar support seat 11*b* and associated modified first and second longitudinally aligned support plates 15*b* and 16*b*, again longitudinally aligned for the minor axis of the seat 11. A series of perimeter drain apertures 25 are directed through the perimeter defined by the seat 11*b* and the modified support plates 15*b* and 16*b* further including a respective first and second opening 28 and 29 positioned adjacent forward edges of each of the modified support plates 15*b* and 16*b* to receive respective first and second hook members 30 and 31 fixedly mounted to respective first and second tubular supports 26*a* and 27*a* that each respectively receive slidingly therewithin a respective first and second tubular support link 26 and 27. Forward ends of the tubular support links 26 and 27 are orthogonally and fixedly mounted to opposed ends of a plate member 32 that includes first and second opposed vertical leg members 33 and 34 mounted fixedly to each opposed end of the plate member 32, and the leg members 32 and 34 terminate in a horizontal support rod that includes a surrounding cylindrical cushioned foot rest 35 that is aligned parallel and overlying the plate member 32 to enable an individual to rest one or both feet thereon during a bathing event.

Figure 2:
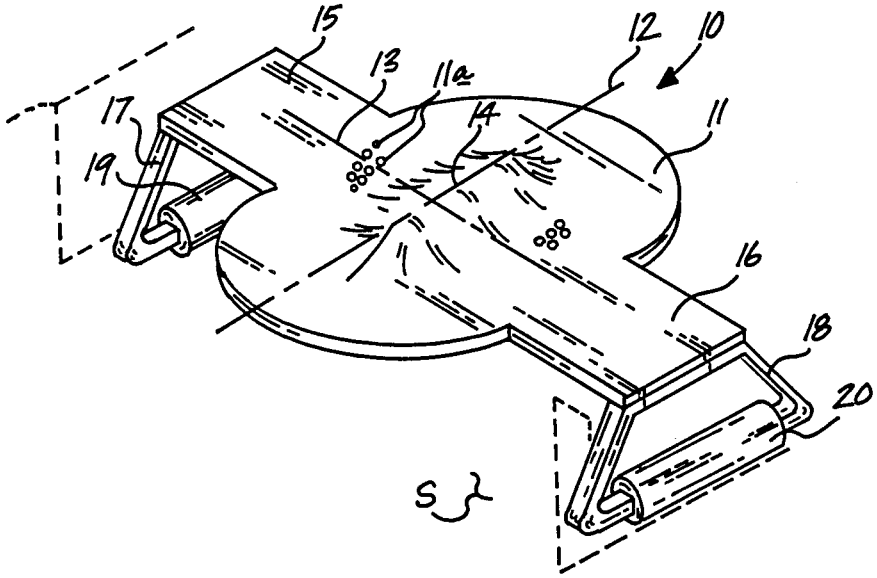
PRIOR ART FIG 2
FIG. 2 is an isometric illustration of the instant invention.
Figure 6:
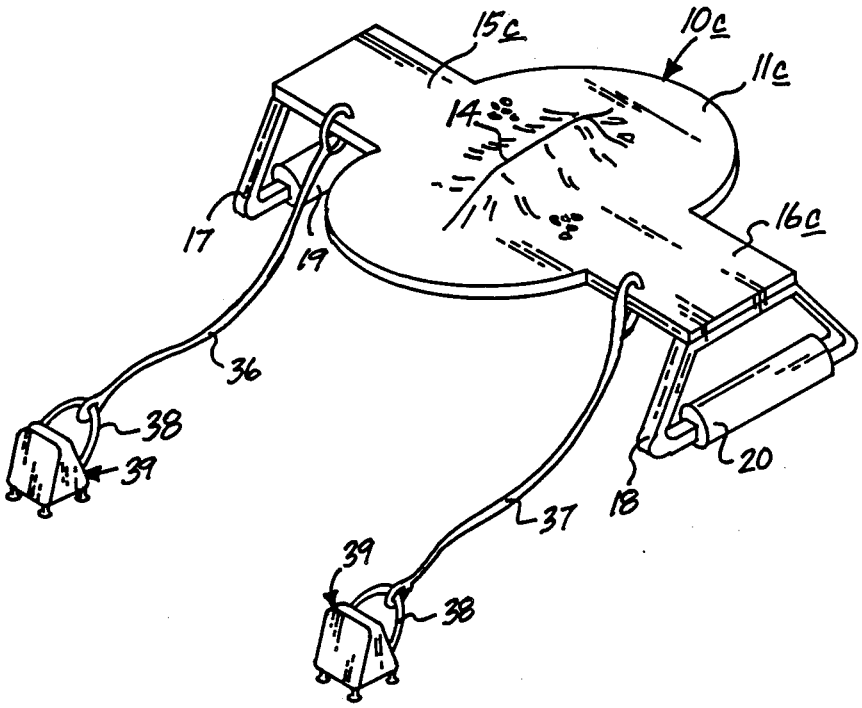
FIG. 6 is an isometric illustration of a yet further modified bathtub seat apparatus of the instant invention.

FIG. 6 illustrates a still further modified bathtub seat apparatus 10*c* wherein the elliptical support seat 11*c* is of a general configuration to that as illustrated in FIG. 2, but includes a first and second flexible tether line 36 and 37 fixedly secured to a respective forward edge of each of the support plates 15*c* and 16*c*. Forward ends of the tether lines 36 and 37 are terminating in loops that secure a respective loop member 38 of an associated convex foot rest 39. The convex foot rest 39 is of a generally triangular cross-sectional configuration formed with suction cup foot members 41 at corner portions of a support base and includes a cavity 40 formed with a polymeric foam lining within the foot rest 39.

Figure 7:
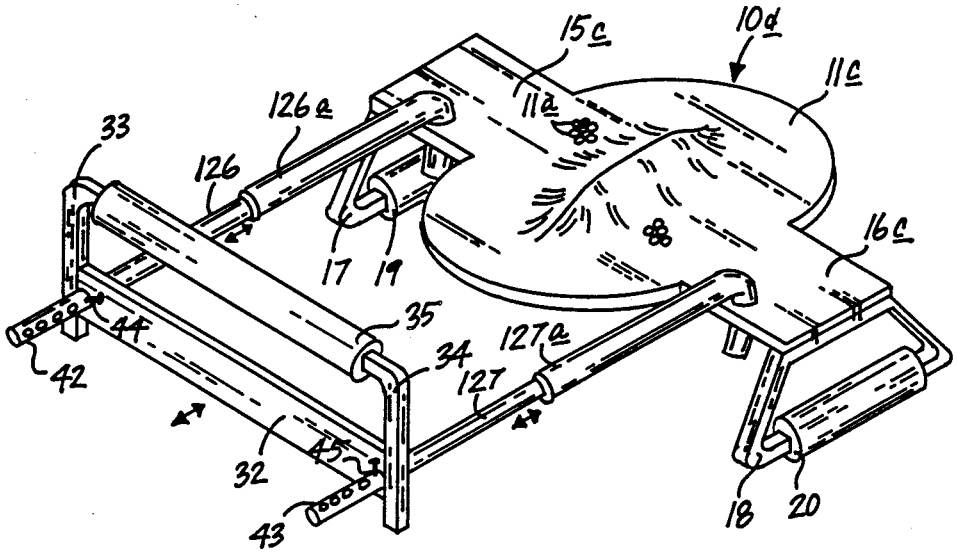
FIG. 7 is an isometric illustration of an additional bathtub seat apparatus as set forth by the instant invention.
Figure 8B:
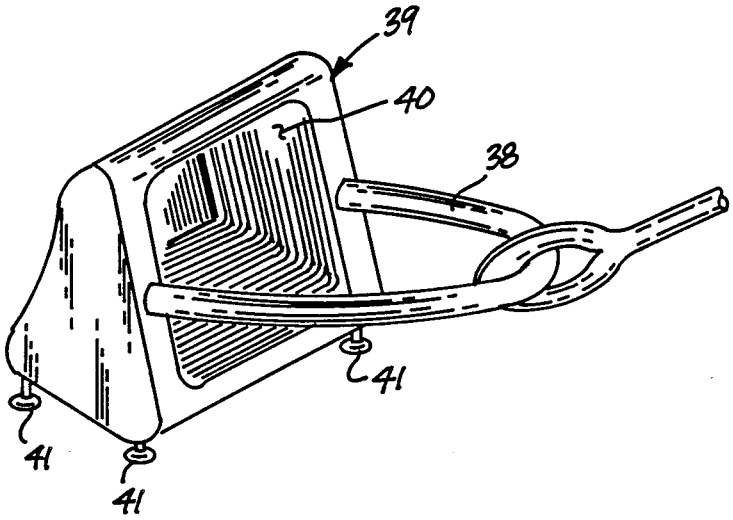
FIG. 8 is an isometric illustration, somewhat enlarged, of a foot support utilized by the instant invention, as illustrated in FIG. 6.

FIG. 7 illustrates an additional bathtub seat apparatus 10*d* where in additional to the drainage holes 11*a*, the use of support members 126*a* and 127*a* of tubular configuration to telescopingly receive modified tubular support links 126 and 127 are formed, wherein each of the support links 126 and 127 are formed with respective first and second apertured forward ends 42 and 43 that recieve selectively a respective first and second lock pin 44 and 45 to position the cushioned foot reset 35 along the associated modified support links 126 and 127, wherein during a bathing event, the tubular foot rest 35 may be positioned under the knee portions of a bather for comfort and use of the device during a bathing event.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bathtub apparatus comprising, in combination, a central planar seat, and a respective first and second wing member fixedly mounted to each side of the planar seat and extending outwardly therefrom, and a respective first and second support framework integrally mounted to a forward bottom end edge of each respective first and second wing member, and a respective first and second cushioned tubular support mounted in a surrounding relationship to a respective first and second base member of each respective first and second support framework, and each tubular support includes a planar ribbed bottom surface, and wherein mounting of each respective first and second wing member includes a respective first and second tubular support, each respective first and second tubular support telescopingly receiving each respective first and second wing member therewithin, and each respective first and second tubular support fixedly mounted to an opposed side of the planar seat, and the planar seat is configured of an elliptical configuration, with each respective first and second tubular support aligned with the minor axis defining the elliptical seat, and the elliptical planar seat further including a ridge extending upwardly of the planar seat aligned with a major axis defining the elliptical planar seat, and a matrix of drainage apertures directed through the elliptical planar seat, and a respective first and second support framework defined at a trapezoidal configuration with the respective first and second base member defining a bottom link of each trapezoidal support framework, and wherein each respective first and second wing member is selectively clamped interiorly of each respective first and second tubular support, including a threaded boss mounted to each respective first and second wing member extending through a respective first and second slot directed through the respective first and second tubular supports, and a clamping portion associated with each threaded boss to secure the respective first and second wing member relative to each respective first and second tubular support, and wherein each respective first and second wing member includes a respective first and second elongate suction cup coextensive with each end surface of each respective first and second wing member.

2. A bathtub apparatus as set forth in claim 1 wherein each respective first and second wing member includes an "L" shaped support telescopingly receiving a link therewithin, and each link mounted at its forward end to a plate member, the plate member including a vertical leg integrally mounted to each side of the plate member, and each leg terminating in a single support rod interconnecting each leg with a cushioned tubular foot rest in surrounding relationship relative to the rod.

3. A bathtub apparatus as set forth in claim 1 wherein each respective first and second wing member includes a flexible tether line secured to a forward edge of each wing member, and each tether line slidingly receiving a loop at a forward end of each tether line, and each loop secured to a foot rest, each foot rest of a triangular cross-sectional configuration formed with a planar base, the planar base including a plurality of foot member suction cups secured thereto, wherein each of the foot member suction cups positioned for securement to a top surface of an associated bathtub, with each foot rest including a cavity formed therein, and each cavity including a polymeric liner formed therein.

* * * * *